US005439218A

United States Patent [19]

Gondeck

[11] Patent Number: 5,439,218

[45] Date of Patent: Aug. 8, 1995

[54] GOLF CLUB HOSEL CONSTRUCTION

[76] Inventor: Richard W. Gondeck, 31 Bryce Ct., Baltimore, Md. 21236

[21] Appl. No.: 367,895

[22] Filed: Jan. 3, 1995

[51] Int. Cl.[6] ..... A63B 53/02

[52] U.S. Cl. ..... 273/80.5; 273/80.8

[58] Field of Search ..... 273/80 R, 80.2–80.9, 273/167 K

[56] References Cited

U.S. PATENT DOCUMENTS

| | | | |
|---|---|---|---|
| 2,203,893 | 6/1940 | Chapman | 273/80.2 |
| 3,614,101 | 10/1971 | Hunter | 273/80.2 |
| 3,640,534 | 2/1972 | Mills | 273/167 K |
| 3,819,181 | 6/1974 | Mills | 273/80.2 |
| 4,063,737 | 12/1977 | Tom et al. | 273/80.5 |
| 4,854,583 | 8/1989 | Kobayashi | 273/80.2 |

*Primary Examiner*—Vincent Millin
*Assistant Examiner*—Steven B. Wong

[57] ABSTRACT

A new and improved golf club head having a toe end, a heel end, a golf ball hitting face, bottom sole and a top surface. A hollow cylindrical wall has an upper end, a lower end and an intermediate extent therebetween. The hollow cylindrical wall is formed integrally with the heel end of the golf club head, the hollow cylindrical wall having a tapering thickness, with a minimum wall thickness being at the upper end of the cylindrical wall and a maximum wall thickness being at the lower end of the cylindrical wall. The lower end of the cylindrical wall is integral with the golf club head, the upper end of the cylindrical wall extending above the top surface of the golf club head. A cylindrical groove has an open upper end and a closed lower end, the groove being formed about the cylindrical wall within the golf club head. The closed lower end of the groove is formed about the lower end of the cylindrical wall, and the open upper end of the groove is formed about the intermediate extent of the cylindrical wall where the hollow shaft extends into the golf club head. A golf club shaft has an upper end, a lower end and an intermediate extent therebetween, the lower end of the golf club shaft adapted to be inserted over the cylindrical wall and bonded within the groove.

5 Claims, 4 Drawing Sheets

GOLF CLUB HOSEL CONSTRUCTION

BACKGROUND OF THE INVENTION

1. Field of the Invention

The present invention relates to golf club hosel construction and more particularly pertains to compacting the weight of a club head closer to the hitting area.

2. Description of the Prior Art

The use of hosels is known in the prior art. More specifically, hosels heretofore devised and utilized for the purpose of connecting a shaft to a club head are known to consist basically of familiar, expected, and obvious structural configurations, notwithstanding the myriad of designs encompassed by the crowded prior art which has been developed for the fulfillment of countless objectives and requirements.

For example, U.S. Pat. No. 5,255,919 to Johnson discloses a hosel construction for a golf putter.

U.S. Pat. No. 5,222,734 to Parente et al. discloses iron golf club heads.

Likewise, U.S. Pat. No. 5,067,711 to Parente et al. also discloses iron golf club heads.

Furthermore, U.S. Pat. No. 4,951,949 to Kastenhuber discloses a lightweight split hosel and putter head.

Lastly, U.S. Pat. No. 5,056,788 to Katayama discloses a club set with progressively altered hosel thickness and head weight.

In this respect, the golf club hosel construction according to the present invention substantially departs from the conventional concepts and designs of the prior art, and in doing so provides an apparatus primarily developed for the purpose of compacting the weight of a club head closer to the hitting area.

Therefore, it can be appreciated that there exists a continuing need for new and improved golf club hosel construction which can be used for compacting the weight closer to the hitting area. In this regard, the present invention substantially fulfills this need.

SUMMARY OF THE INVENTION

In view of the foregoing disadvantages inherent in the known types of hosels now present in the prior art, the present invention provides an improved golf club hosel construction. As such, the general purpose of the present invention, which will be described subsequently in greater detail, is to provide a new and improved golf club hosel construction and method which has all the advantages of the prior art and none of the disadvantages.

To attain this, the present invention essentially comprises a golf club head having a toe end, a heel end, a golf ball hitting face, bottom sole and a top surface. A hollow cylindrical wall has an upper end, a lower end and an intermediate extent therebetween, the hollow cylindrical wall formed integrally with the heel end of the golf club head. The hollow cylindrical wall has a tapering thickness, with a minimum wall thickness being at the upper end of the cylindrical wall and a maximum wall thickness being at the lower end of cylindrical wall. The lower end of the cylindrical wall is integral with the golf club head approximate the bottom sole. The upper end of the cylindrical wall extends above the top surface of the golf club head. A cylindrical V-shaped groove has an open upper end and a closed lower end, the V-shaped groove being formed about the cylindrical wall within the golf club head, the closed lower end of the V-shaped groove being formed about the lower end of the cylindrical wall approximate the bottom sole of the golf club head, and the open upper end of the V-shaped groove being formed about the intermediate extent of the cylindrical wall where the hollow shaft extends into the golf club head. A golf club shaft has an upper end, a lower end and an intermediate extent therebetween, the lower end of the golf club shaft adapted to be inserted over the cylindrical wall and bonded within the V-shaped groove. A cylindrical hollow cover has an upper end and a lower end and an intermediate extent therebetween, the cover having a tapering sidewall thickness with a minimum sidewall thickness at the upper end and a maximum sidewall thickness at the lower end, the cover adapted to be inserted over both the golf club shaft and the cylindrical wall with the lower end of the cover adjacent the top surface of the golf club head and the upper end adjacent the golf club shaft. The cover functions to give a tapered appearance in between the top surface of the golf club head and the golf club shaft.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved golf club hosel construction which has all the advantages of the prior art hosels and none of the disadvantages.

It is another object of the present invention to provide new and improved golf club hosel construction which may be easily and efficiently manufactured and marketed.

It is further object of the present invention to provide new and improved golf club hosel construction which is of durable and reliable constructions.

An even further object of the present invention is to provide new and improved golf club hosel construction which is susceptible of a low cost of manufacture with regard to both materials and labor, and which accordingly is then susceptible of low prices of sale to the consuming public, thereby making such golf club hosel construction economically available to the buying public.

Still yet another object of the present invention is to provide new and improved golf club hosel construction which provides in the apparatuses and methods of the prior art some of the advantages thereof, while simultaneously overcoming some of the disadvantages normally associated therewith.

Even still another object of the present invention is to compact the weight of a golf club head closer to the hitting area.

Lastly, it is an object of the present invention to provide a new and improved golf club head having a toe end, a heel end, a golf ball hitting face, bottom sole and a top surface. A hollow cylindrical wall has an upper end, a lower end and an intermediate extent therebetween. The hollow cylindrical wall is formed integrally with the heel end of the golf club head, the hollow cylindrical wall having a tapering thickness, with a minimum wall thickness being at the upper end of the cylindrical wall and a maximum wall thickness being at the lower end of the cylindrical wall. The lower end of the cylindrical wall is integral with the golf club head, the upper end of the cylindrical wall extending above the top surface of the golf club head. A cylindrical groove has an open upper end and a closed lower end, the groove being formed about the cylindrical wall within the golf club head. The closed lower end of the groove is formed about the lower end of the cylindrical wall, and the open upper end of the groove is formed about the intermediate extent of the cylindrical wall where the hollow shaft extends into the golf club head. A golf club shaft has an upper end, a lower end and an intermediate extent therebetween, the lower end of the golf club shaft adapted to be inserted over the cylindrical wall and bonded within the groove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
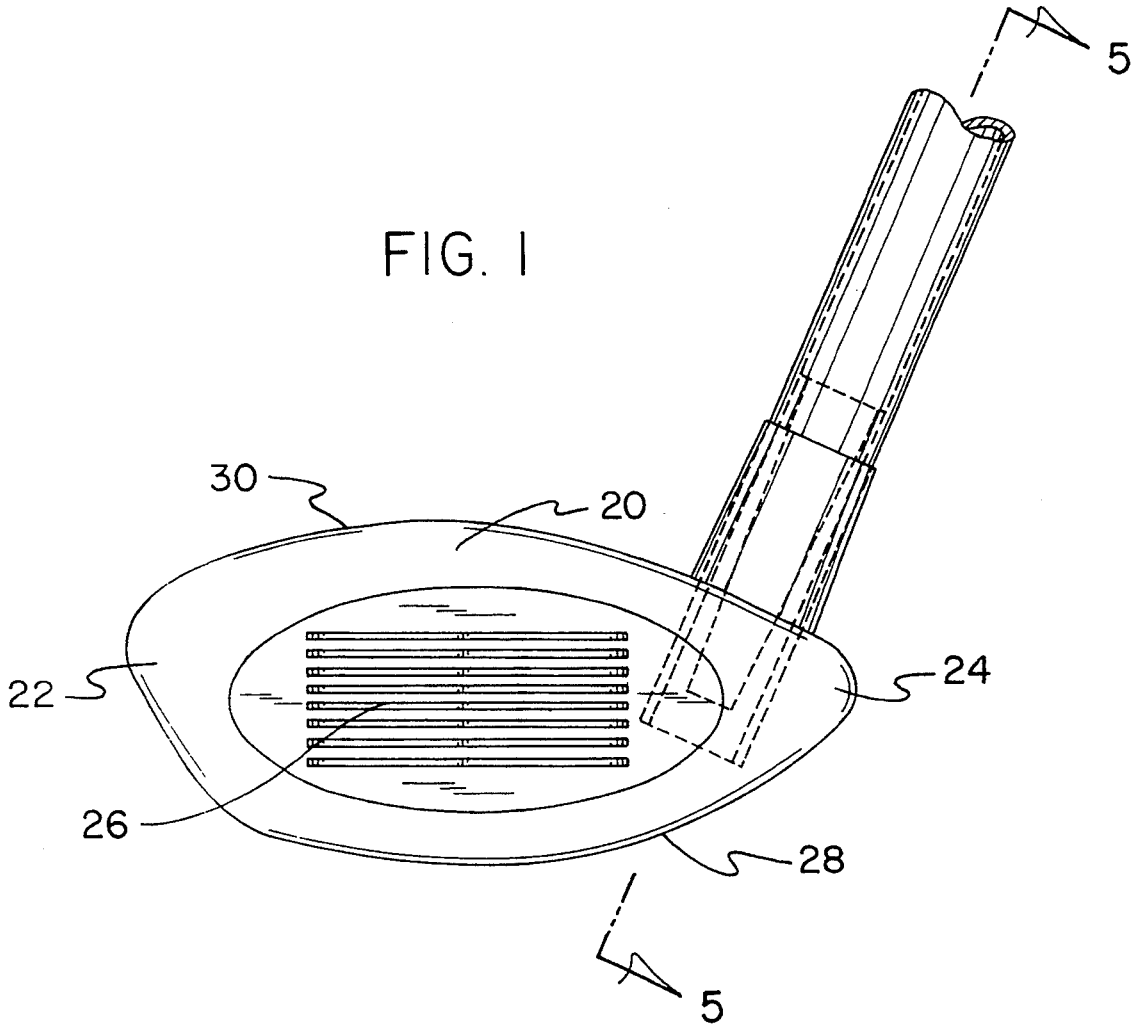
FIG. 1 is a side elevational view of the preferred embodiment of the golf club hosel construction constructed in accordance with the principles of the present invention.
Figure 2:
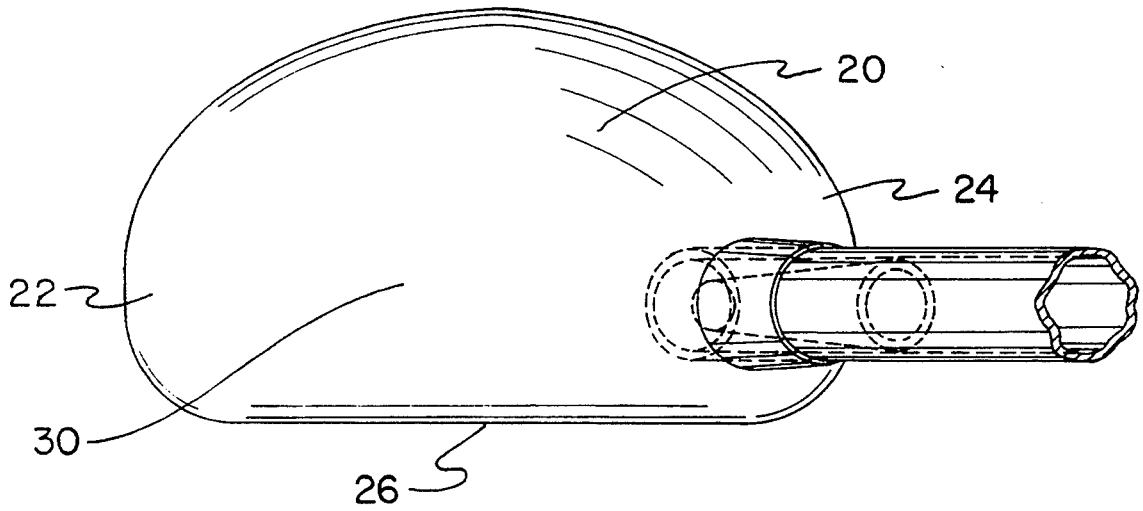
FIG. 2 is plan view of the preferred emboidment of the present invention.
Figure 3:
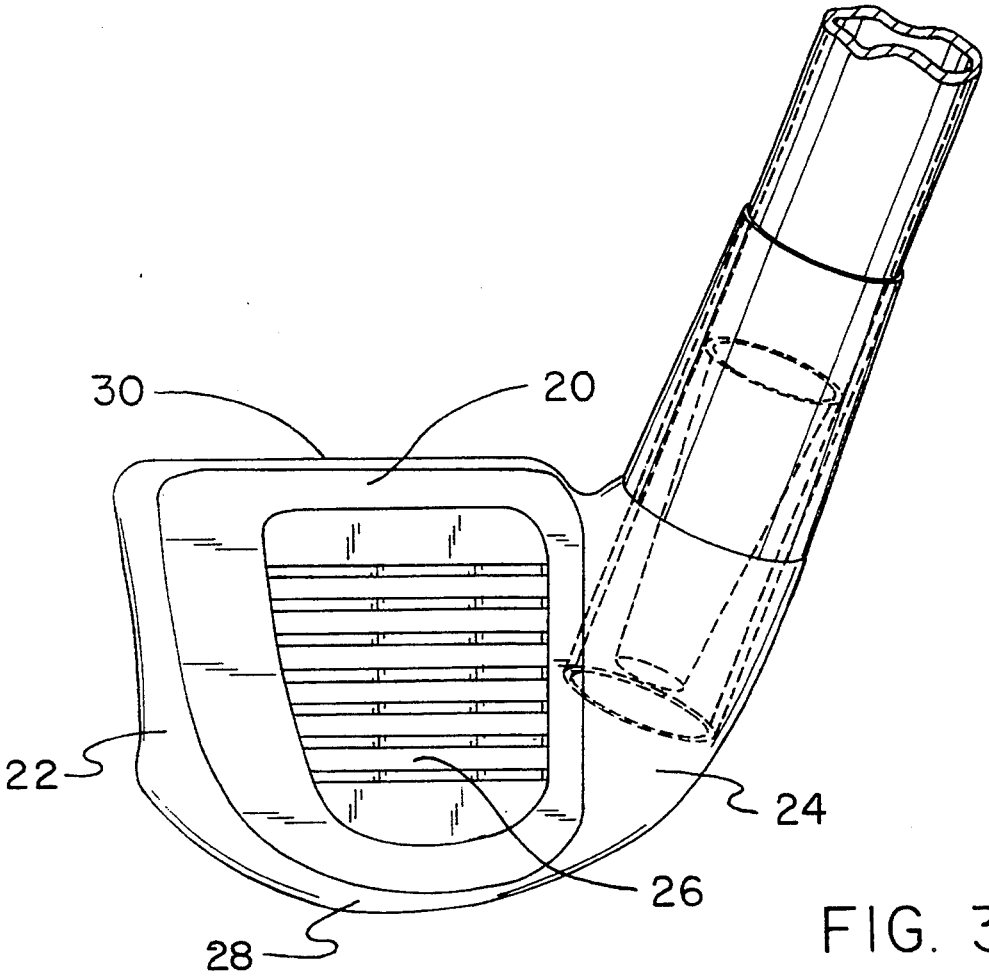
FIG. 3 is a side elevational view of the perferred embodiment of the present invention.
Figure 4:
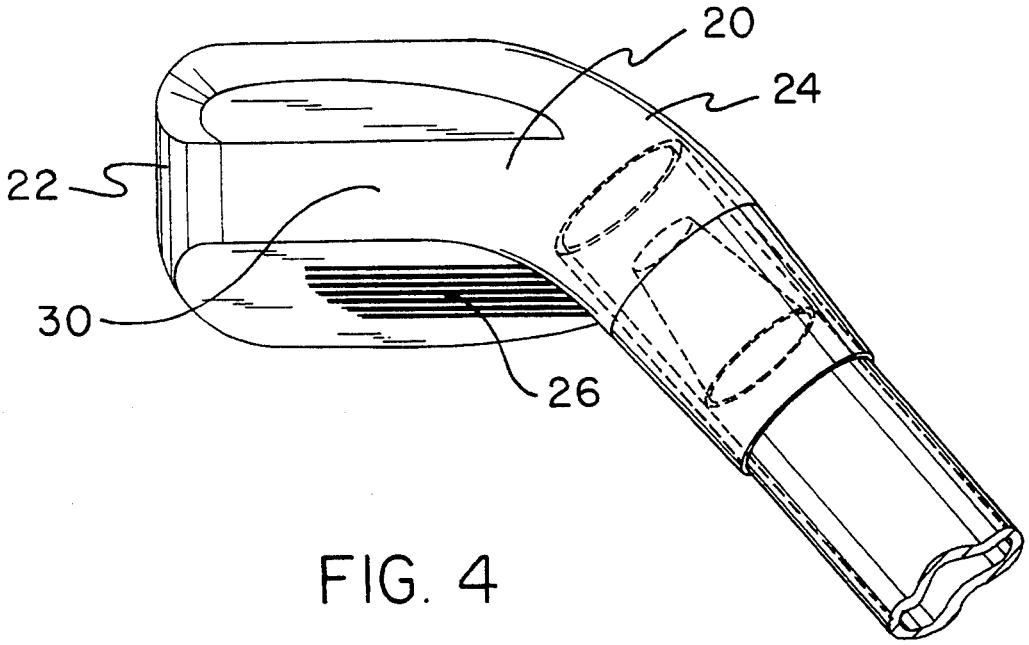
FIG. 4 is a plan view of the perferred emboidment of the present invention.
Figure 5:
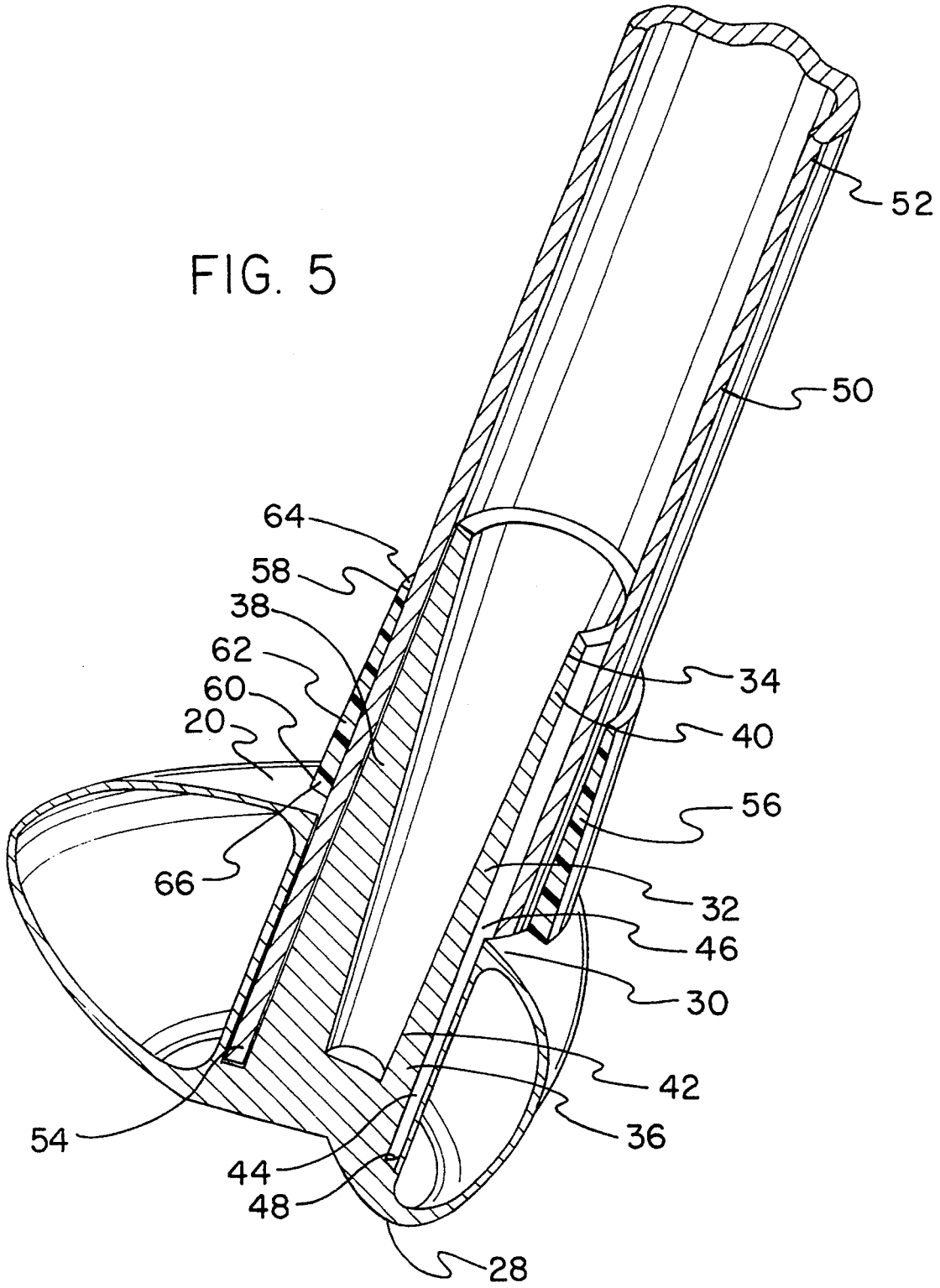
FIG. 5 is a view taken along line 5—5 of FIG. 1.
Figure 6:
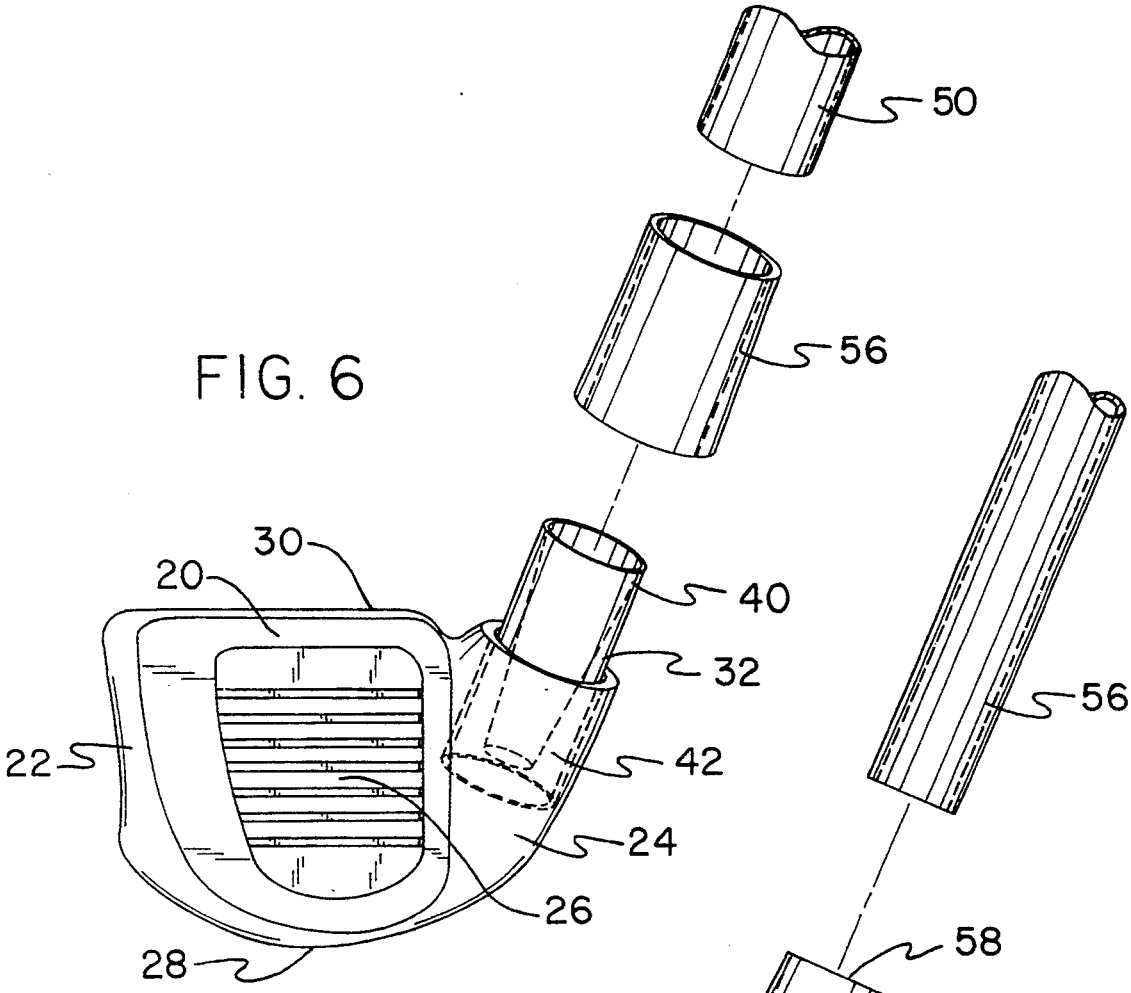
FIG. 6 is an exploded view of the preferred embodiment of the present invention.
Figure 7:
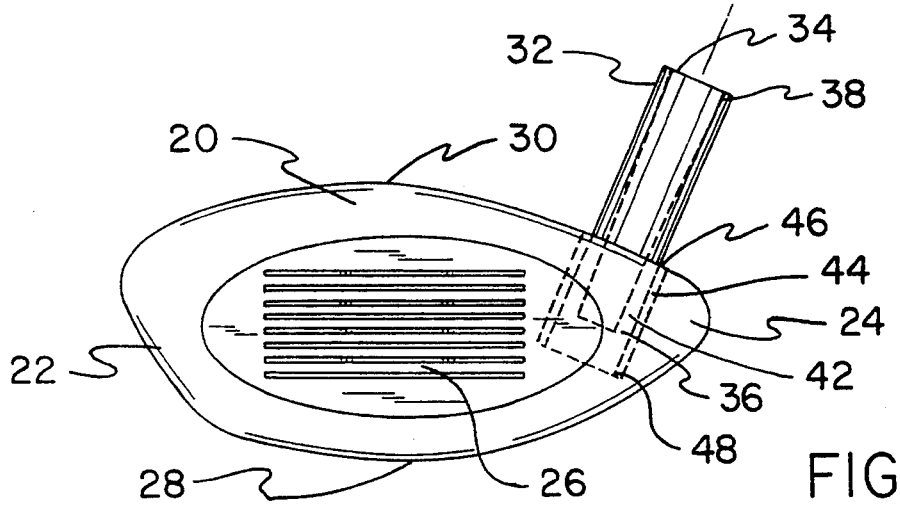
FIG. 7 is an exploded view of the preferred embodiment of the present invention.

With reference now to the drawings, and in particular to FIG. 1 thereof, the preferred embodiment of the new and improved golf club hosel construction embodying the principles and concepts of the present invention and generally designated by the reference numeral 10 will be described.

The present invention relates to a new and improved golf club hosel construction. In its broadest context, the present invention includes a golf club head 20 with an integral cylindrical wall 32 and V-shaped groove 44 formed therearound. A standard shaft 50 is fitted over the cylindrical wall 32. A cylindrical cover 56 can be inserted over the shaft 50 to give a tapered appearance between the golf club and the shaft 50.

The golf club head 20 can be any one of a variety of heads now used in the art. Within the context of the present invention the term club head can refer to irons, woods, metal woods and putter heads. In each instance the golf club head 20 has a toe end 22, a heel end 24, a golf ball hitting face 26, bottom sole 28 and a top surface 30.

The hollow cylindrical wall 32 has an upper end 34, a lower end 36 and an intermediate extent 38 therebetween. The hollow cylindrical wall 32 is formed integrally with the heel end 24 of the golf club head 20. Thus, in the preferred embodiment, the cylindrical wall 32 is constructed from the same material the club head 20 is constructed from, for example, graphite, wood or titanium. The hollow cylindrical wall 32 has a tapering thickness, with a minimum wall thickness 40 being at the upper end 34 of the cylindrical wall 32 and a maximum wall thickness 42 being at the lower end 36 of cylindrical wall 32. The lower end 36 of the cylindrical wall 32 is integral with the golf club head 20. In the preferred embodiment, the lower end 36 of the cylindrical wall 32 is integral with the golf club head 20 approximate the bottom sole 28 of the club. The upper end 34 of the cylindrical wall 32 extends above the top surface 30 of the golf club head 20.

A cylindrical groove 44 is formed about the cylindrical wall 32. In the preferred embodiment, the cylindrical groove 44 is V-shaped. The cylindrical V-shaped groove 44 has an open upper 46 end and a closed lower 48 end. The V-shaped groove 44 is formed about the cylindrical wall 32 within the golf club head 20, with the closed lower 48 end of the V-shaped groove 44 being formed about the lower end 36 of the cylindrical wall 32. In the preferred embodiment, the closed lower end 48 of the V-shaped groove 44 is approximate the bottom sole 28 of the golf club head 20. The open upper 46 end of the V-shaped groove 44 is formed about the intermediate extent 38 of the cylindrical wall 32 where the hollow shaft 50 extends into the golf club head 20.

A golf club shaft 50 which has an upper end 52, a lower end 54 and an intermediate extent therebetween is adapted to be inserted over the cylindrical wall 32. Furthermore, the lower end 54 of the golf club shaft 50 is adapted to be bonded within the V-shaped groove 44. This bonding between the V-shaped groove 44 and the club shaft 50 can be achieved by any number of techniques well known in the art. For example, an epoxy could be utilized for the bond.

In one embodiment of the present invention, a cylindrical hollow cover 56 is inserted over the club shaft 50. The hollow cover 56 has an upper end 58, a lower end 60 and an intermediate extent 62 therebetween. The cover 56 has a tapering sidewall thickness with a minimum sidewall thickness 64 at the upper end 58 and a maximum sidewall thickness 66 at the lower end 60. The cover 56 is adapted to be inserted over both the golf club shaft 50 and the cylindrical wall 32 with the lower end 60 of the cover 56 adjacent the top surface 30 of the golf club head 20 and the upper end 58 adjacent the golf club shaft 50. Thus, the cover 56 functions to give a tapered appearance inbetween the top surface 30 of the golf club head 20 and the golf club shaft 50.

Thus, the present invention relates to a golf club with a head which has a shaft connection incorporated into the head to compact the weight closer to the hitting area on the face. The shaft fits into a deep groove at the heel of the club head. The plug that is formed by the addition of the groove fits into the inside diameter of the shaft to support the thin walled material. Adhesives or other means attach the shaft to the club head. Metal club heads on "woods" are made of alloys like aluminum and the like and are produced by casting, using special processes that control the dimensions very accurately. This head lends itself to being produced by that process, probably supplements by a finishing operation on the deep groove, using a trepanning type of tool. The conventional hosel with a socket for a shaft that is present on all club heads is not found on these clubs. The design of this club head does not affect how it is used by the golfer. There is no need to alter the swing, stance, or other elements, but the results will be immediately apparent in how the club feels, especially at impact with the ball. Golf club designers have been changing club head shapes and configurations regularly, striving to utilize the weight in the most efficient manner possible. This product is a significant advancement in that direction.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved golf club hosel construction comprising, in combination:

a golf club head having a toe end, a heel end, a golf ball hitting face, bottom sole and a top surface;

a hollow cylindrical wall having an upper end, a lower end and an intermediate extent therebetween, the hollow cylindrical wall formed integrally with the heel end of the golf club head, the hollow cylindrical wall having a tapering thickness, with a minimum wall thickness being at the upper end of the cylindrical wall and a maximum wall thickness being at the lower end of cylindrical wall, the lower end of the cylindrical wall being integral with the golf club head approximate the bottom sole, the upper end of the cylindrical wall extending above the top surface of the golf club head;

a cylindrical V-shaped groove having an open upper end and a closed lower end, the V-shaped groove being formed about the cylindrical wall within the golf club head, the closed lower end of the V-shaped groove being formed about the lower end of the cylindrical wall approximate the bottom sole of the golf club head, and the open upper end of the V-shaped groove being formed about the intermediate extent of the cylindrical wall where the hollow shaft extends into the golf club head;

a golf club shaft having an upper end, a lower end and an intermediate extent therebetween, the lower end of the golf club shaft adapted to be inserted over the cylindrical wall and bonded within the V-shaped groove;

a cylindrical hollow cover having a upper end and a lower end and an intermediate extent therebetween, the cover having a tapering sidewall thickness with a minimum sidewall thickness at the upper end and a maximum sidewall thickness at the lower end, the cover adapted to be inserted over both the golf club shaft and the cylindrical wall with the lower end of the cover adjacent the top surface of the golf club head and the upper end adjacent the golf club shaft, the cover functioning to give a tapered appearance inbetween the top surface of the golf club head and the golf club shaft.

2. A new and improved golf club hosel construction comprising:

a golf club head having a toe end, a heel end, a golf ball hitting face, bottom sole and a top surface;

a hollow cylindrical wall having an upper end, a lower end and an intermediate extent therebetween, the hollow cylindrical wall formed integrally with the heel end of the golf club head, the hollow cylindrical wall having a tapering thickness, with a minimum wall thickness being at the upper end of the cylindrical wall and a maximum wall thickness being at the lower end of the cylindrical wall, the lower end of the cylindrical wall being integral with the golf club head, the upper end of the cylindrical wall extending above the top surface of the golf club head;

a cylindrical groove having an open upper end and a closed lower end, the groove being formed about the cylindrical wall within the golf club head, the closed lower end of the groove being formed about the lower end of the cylindrical wall, and the open upper end of the groove being formed about the intermediate extent of the cylindrical wall where a shaft extends into the golf club head;

a hollow golf club shaft having an upper end, a lower end and an intermediate extent therebetween, the lower end of the golf club shaft adapted to be inserted over the cylindrical wall and bonded within the groove.

3. The hosel construction as described in claim 2 further comprising:

a cylindrical hollow cover having an upper end and a lower end and an intermediate extent therebetween, the cover having a tapering sidewall thickness with a minimum sidewall thickness at the upper end and a maximum sidewall thickness at the lower end, the cover adapted to be inserted over both the golf club shaft and the cylindrical wall with the lower end of the cover adjacent the top surface of the golf club head and the upper end adjacent the golf club shaft, the cover functioning to give a tapered appearance inbetween the top surface of the golf club head and the golf club shaft.

4. The hosel construction as described in claim 2 wherein:

the cylindrical groove is V-shaped with a closed lower end and an opened upper end.

5. The hosel construction as described in claim 2 wherein:

the lower end of the cylindrical wall is integral with the golf club head adjacent the bottom sole of the golf club head.

* * * * *